US005192038A

United States Patent [19]

Ocampo

[11] Patent Number: 5,192,038

[45] Date of Patent: Mar. 9, 1993

[54] SAFETY DETECTOR FOR RAILROAD SWITCH POINTS WITH VISUAL INDICATOR MECHANISM

[76] Inventor: Salvador C. Ocampo, 4715 W. Wrightwood Ave., Chicago, Ill. 60639

[21] Appl. No.: 889,061

[22] Filed: May 26, 1992

Related U.S. Application Data

[63] Continuation-in-part of Ser. No. 776,725, Mar. 19, 1992, Pat. No. 5,116,006, which is a continuation of Ser. No. 405,659, Sep. 11, 1989, abandoned.

[51] Int. Cl.[5] ..... B61L 5/10

[52] U.S. Cl. ..... 246/220; 246/162; 246/476

[58] Field of Search ..... 246/162, 176, 220, 476, 246/473.1; 200/239, 249, 251, 286, 341

[56] References Cited

U.S. PATENT DOCUMENTS

| | | | |
|---|---|---|---|
| 500,041 | 6/1893 | Swartz | 246/220 |
| 763,420 | 6/1904 | Owen | 246/220 X |
| 975,922 | 11/1910 | Adams | 246/220 X |
| 1,038,450 | 9/1912 | Showalter | 246/220 |
| 1,781,284 | 11/1930 | Karl | 246/176 |
| 2,740,041 | 3/1956 | Marcum | 246/220 |
| 4,108,405 | 8/1978 | Gibson | 246/473.1 X |
| 4,986,498 | 1/1991 | Rotter et al. | 246/220 X |

FOREIGN PATENT DOCUMENTS

| | | | |
|---|---|---|---|
| 598866 | 12/1925 | France | 246/162 |
| 629299 | 11/1927 | France | 246/220 |
| 761457 | 3/1934 | France | 246/220 |
| 52348 | 4/1910 | Switzerland | 246/162 |

*Primary Examiner*—Frank E. Werner
*Assistant Examiner*—Scott L. Lowe
*Attorney, Agent, or Firm*—Martin Faier

[57] ABSTRACT

A safety detector for a railroad switch point having a detector mechanism which is to be secured to a stockrail at the switch point where the stockrail is intended to be in contact with a corresponding switchrail, in which the detector mechanism is adjustably secured in a housing located below the stack rail and has a spring loaded plunger assembly normally biased in the direction of the switchrail and reciprocably secured preferably beneath the stockrail in alignment with the switchrail at the switch point, electrical contacts connected to the plunger assembly for reporting contact or the lack of contact between the switchrail and the stockrail, and a contact on the switchrail at the switchpoint for reciprocating the plunger against the electrical reporting contacts when the switchrail is in physical contact with the stockrail at the switchpoint. Preferably, the detector mechanism also includes visual indicators for reporting whether the switch point is open or closed, and which may be solar or battery powered and may be capable of selective adjustment to warn operating personnel of the condition of the switch point.

27 Claims, 5 Drawing Sheets

FIG. 11
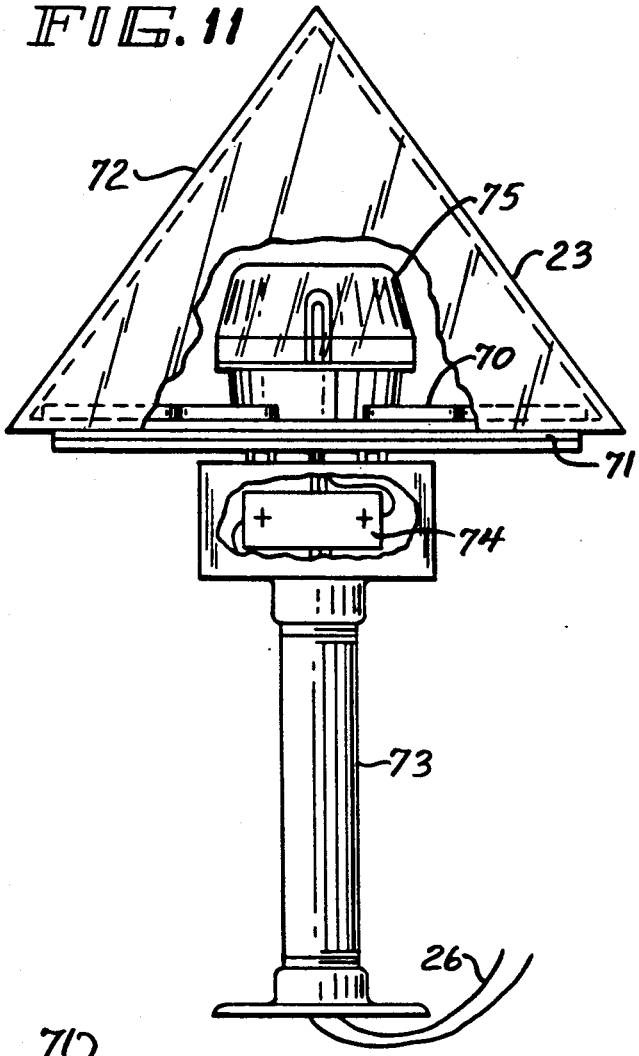
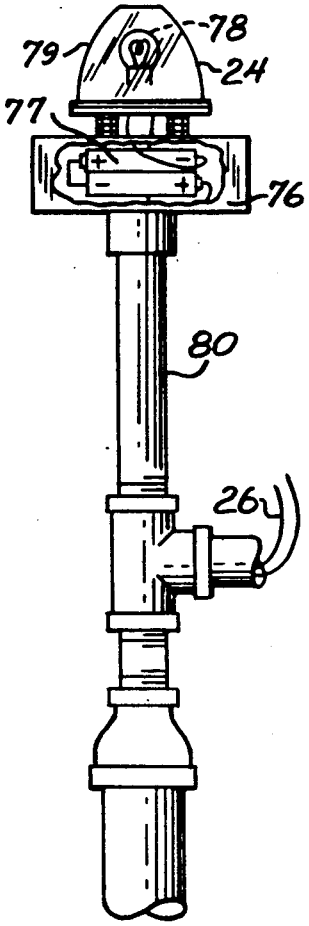
FIG. 13
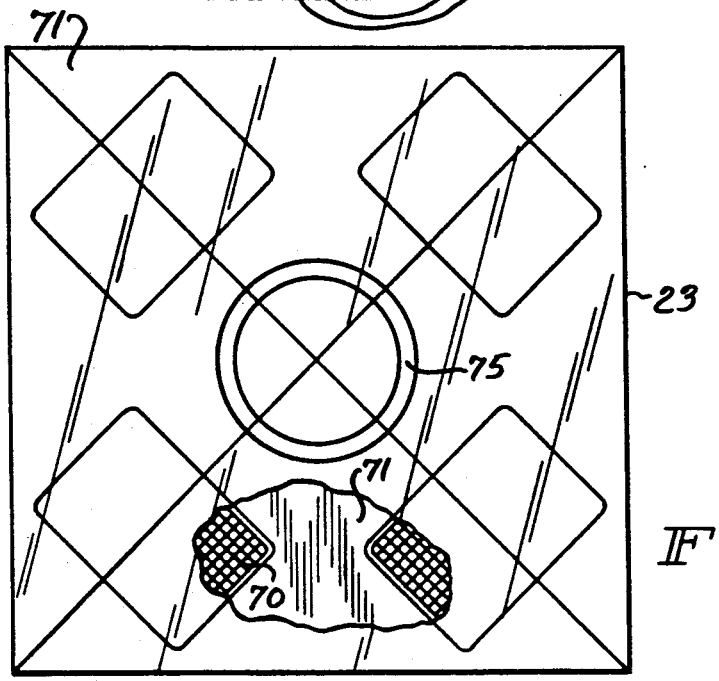
FIG. 12

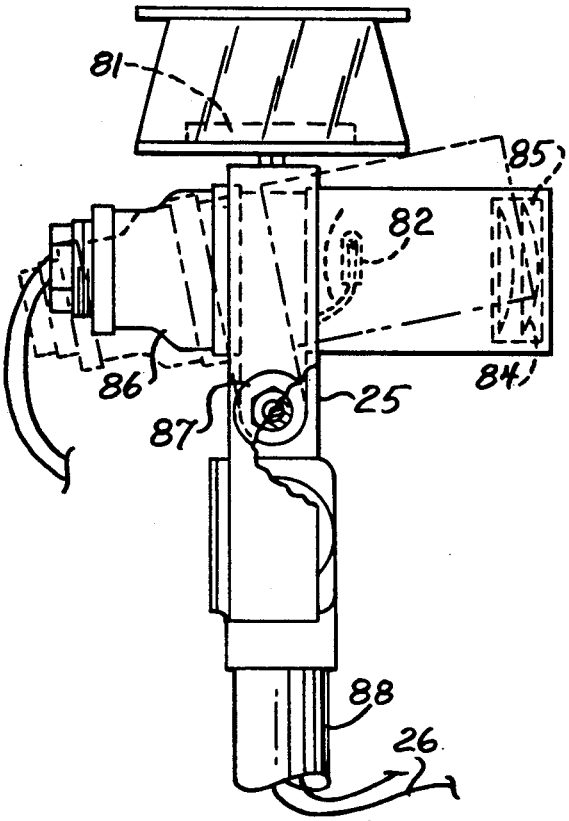
FIG. 14
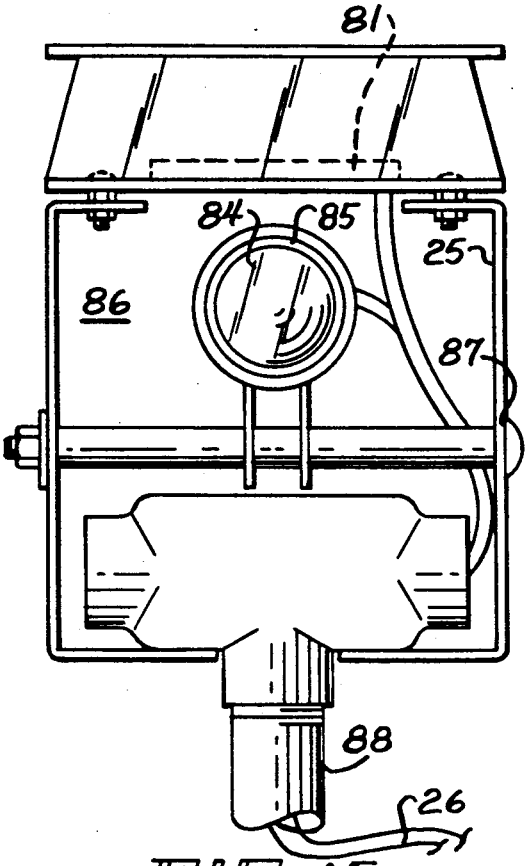
FIG. 15
FIG. 16
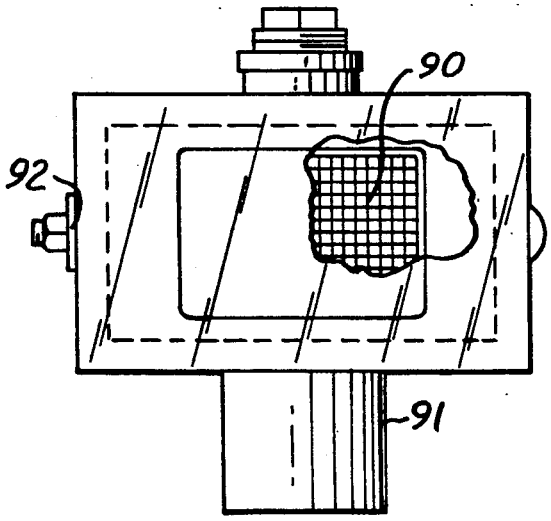

SAFETY DETECTOR FOR RAILROAD SWITCH POINTS WITH VISUAL INDICATOR MECHANISM

This application is a continuation in part of my copending application Ser. No. 07/776,725, for a SAFETY DETECTOR FOR RAILROAD SWITCH POINTS WITH REMOTE CONTACT MECHANISM, filed Mar. 19, 1992, now U.S. Pat. No. 5,116,606, granted May 26, 1992, which is a continuation of my application Ser. No. 07/405,659, for a SAFETY DETECTOR FOR RAILROAD SWITCH POINTS, filed Sep. 11, 1989, and now abandoned.

This invention relates to a safety detector for railroad switch points, with a visual indicator mechanism, and is more particularly directed to such a device which is capable of positively indicating whether or not the point of a railroad switch track is open or closed and warning operating personnel of the condition of the switchpoint, irrespective of the presence of a source of line current.

BACKGROUND OF THE INVENTION

Devices intended for ascertaining whether or not a railroad switch is open are quite old and have been used in association with most switch mechanisms for many years in railroad yards, hump yards and on mainlines. Such mechanisms depend mostly upon the accuracy and capability of the switch itself to detect failures that will cause the switch point to open. Many devices are very sophisticated and electronically controlled, and such prior art devices frequently are intended to permit ascertaining whether or not the switch is closed from remote points, such as in a yard tower or many miles downline.

However, even in the light of such sophisticated equipment, railroads continue to suffer derailments. It is believed that the cause for many of these derailments can be traced to conventional mechanisms for detecting whether a switch is open or closed. Such prior art mechanisms are usually of a type which detect an obstructed open switch point, but only if the obstruction results in mechanical pressure directed against the switch machine. If there is no obstruction, the detector mechanism may cause an erroneous reading indicating that the switch is open or closed, when in fact the opposite is true.

Many more switches in the railway industry in the United States are manually operated than electrically powered. Such manually operated switch are frequently as dangerous as powered switches because they are usually located in areas where trains loaded with hazardous materials and chemicals and other critical cargos travel. Frequently, derailments at the locations of such switches are also caused by open switchpoints, usually caused by human error or failure to notice that the switchpoint is safely closed against the stockrail during operations in bad weather or without visibility. Also, such manually operated switches are usually in locations where service of the switches is not as effective as desired, making it easier to miss mistakes in calibrations or settings which lead to a false belief that a switchpoint is closed when in fact it is open.

Frequently, existing equipment is relied upon to perform functions not intended; for example, stop signs and similar devices are frequently mechanically attached to manually operated switch gear boxes, but these devices are designed only to indicate which route the switch is directed to and not to whether or not the switchpoint is open or closed. False reliance on these devices, frequently coupled with a switchman's view (usually under pressure to throw another switch and keep the train moving) leads the switchman to assume that the switchpoint is in the position designated just because the switch lever has dropped inside the switch lever slot (with no visual inspection of the switchpoint).

Even with powered switches located in hump or switch yards, where some of the most sophisticated equipment in the world is located, derailments are not infrequent and are often disastrous when they occur. Investigation after such events sometimes reveals an obstruction between the switchpoint and the stockrail, or misadjustment or worn out movable parts and mechanical components, sometimes even a simple light bulb. Such failures can be traced to loose or worn out movable parts and mechanical components, or poor maintenance or loose ballast conditions, or poor maintenance or loose stockrail braces, or worn out or loose throwrod adjusting nuts, or worn out or defective throw rod baskets, or broken throwrods, or worn out or broken lugs connecting the switch sectors and throwrods.

In other cases, the cause is human error, where the complaints that the sun light was too bright to see the safety light in the field or his view of a detector was obstructed. In these situations the "clear" safety signal indication, either in the tower or on the field, is false and can be the direct cause of a derailment. Operating personnel are sometime unable to see the condition of the switchpoint in time to take action avoiding a derailment, because a light is burned out or there is glare or darkened conditions or obstructions or for some other reason which prevents the operator from seeing whether the point is open or closed.

In any of these events, the failure can be traced to the fact that prior art detectors are adjusted and set according to calibration of the detector and the switch point, rather than a positive relationship between the stockrail and the switchrail at the point where they are intended to come together or be separated. In such failures, even if the conventional detector is initially properly calibrated and can be detected, changes occur which make the calibration inaccurate or obscure the detector. If the calibration is changed by some condition which is not regularly detected, sometimes by a misalignment of merely about 0.05 of an inch, such as movement of the tracks relative to one another or movement of the detector or switch components, which may result from vibrations of a locomotive or rolling stock over the track or by change in weather conditions, a derailment may result. Power may also be interrupted or a warning source obliterated or inoperative-any of which can cause a derailment.

SUMMARY OF THE INVENTION

The present invention is designed to offer reliability and accuracy for detecting opening and closing movements of the switch points, particularly where manually operated switches are employed. This invention is characterized by a mechanism securely mounted to the stockrail which positively "feels" the switchtrack in a selected position at the location when the point is selectively opened or closed, so that it positively notes the presence or absence of the switchtrack at the switchpoint. If the detector shows the switch is open or closed at the point, that fact is made known through a signal system.

The detector may also include reliable visual indicator mechanism to warn operating personnel of the condition of the switchpoint. These visual indicators are preferably solar or battery powered, and may include magnifying devices to utilize less power or to be focused to a specific point. Such a positive indication of the condition of the point substantially insures the safety of trains over the switchtrack, and improves the detection and guarantees the anticipation of any opening and closing movement of the switch point under any circumstances.

The improved mechanism embodying the invention provides accurate detection of changes in the point throwrod adjustment which cause the point to open, including failures due to wearing out of movable parts, misalignments, adverse weather conditions, and breakdown of mechanical components which allow the point to open, causing a derailment. With the visual indicator mechanism forming a part of the invention, reliable means, which is not dependent on a conventional source of power, can be provided.

In this invention, the detector system may be clamped to the bottom of the stockrail and comprises and is encased in heavy duty mechanism adequate to hold its adjustment, thus protecting the detector system from misalignment due to vibrations from rolling stock traveling over the track and from various adverse weather conditions which can cause misadjustment of the system components and result in derailments. The mechanism may be fabricated so that it is not readily available to yard personnel or others who may in error vary its calibration.

The present invention also includes visual indicators which may readily show that a switchpoint is in a condition to cause a derailment. These visual displays include solar powered visual indicators which form a part of the present invention, and do not depend upon yard current or and are not susceptible to some human error, but are constructed with low power requirements and are visually quite noticeable. Additionally, these indicators may utilize easily detectable strobe lights, which may be battery powered or solar powered. Such solar or battery powered indicators may be used even where power is not available. The visual indicators may be magnified, too, as to make them easier to read without drawing excessive power. Other visual indicators may also be provided, as part of the present invention, such as adjustable powered indicators which can be focused on moving trains and operating personnel which can readily be noticed so that derailment can usually be avoided.

OBJECTS AND ADVANTAGES OF THE INVENTION

The object and advantage of this invention is to provide a novel safety detector for a railroad switch point of the character referred to.

Another object is to provide novel safety detector means for preventing derailment of railroad rolling stock entering or exiting a switchtrack, irrespective of most misalignments of the switchtrack relative to the stockrail at the switchpoint.

Another object is to provide such a safety detector which is capable of positively indicating whether or not the point of a railroad switch track is open or closed.

Another object is to provide such a safety detector which is firmly secured to a stockrail located at the switchpoint of a switch track.

Another object is to provide such a novel switch detector which extends beneath the stockrail at the intended point where the switchtrack is to be opened or closed against the stockrail.

Another object is to provide novel adjustable heavy duty spring loaded means for detector mechanism, which contacts a switchtrack at the point where it is intended to be opened or closed against a stockrail.

Another object is to provide novel adjustable heavy duty electrical contact and structural members for detector mechanism which are capable of opening or closing a circuit for reporting whether a switchpoint is open or closed and is suitable for holding its adjustment.

Another object is to provide a heavy duty detector mechanism which may be sealed in an adjusted condition, but is available for use and adjustment by trained personnel.

Another object is to provide detector mechanism for a switchpoint which includes noticeable visual indicators showing a switchpoint in open or closed condition.

Another object is to provide visual indicator mechanism for a switchpoint detector which may be solar powered.

Another object is to provide visual indicator mechanism for a switchpoint detector which is adjustable and can be focused to alert moving operator personnel as to whether the switchpoint is open or closed.

Another object is to provide a novel switch detector of the character recited which may be attached to a stockrail between ties and adjusted for contact with the point where a switchrail is intended to be opened or closed against the corresponding stockrail.

Another object is to provide a pair of cooperating detectors of the character recited which may be aligned with opposed points at the precise location where the switchtrack is intended to be opened or closed against the stockrail, and which will indicate whether each point is open or closed.

Another object is to provide novel battery powered visual indicator mechanism of the character described.

Another object is to provide a heavy duty switch housing for such a detector system which is remote from the rail and fully protected against unintended misadjustment.

Another object is to provide connecting means for securely mounting such a detector system to the bottom of the stockrail and switchrail.

Another object is to provide a safety detector for a switch point with visual indicator mechanism which is easy to manufacture, install and use, and which is efficient and reliable in operation.

These and other objects and advantages of the invention will become more apparent as this description proceeds, taken in conjunction with the accompanying drawings.

BRIEF DESCRIPTION OF THE DRAWINGS

In the drawings:

FIG. 11 is a side elevational view of a solar powered visual indicator usable in the detector embodying the present invention.

FIG. 12 is a top plan view of the solar powered visual indicator shown in FIG. 11.

FIG. 13 is a side elevational view of a modified visual indicator for use in the detector system.

FIG. 14 is a side elevational view of a modified solar powered visual indicator which may be focused and magnified to assure the attention of operating personnel.

FIG. 15 is an elevational view of the modified magnified and focusable solar powered visual indicator shown in FIG. 14, taken at a right angle thereto.

FIG. 16 is a side elevational view of another modified solar powered visual indicator.

DESCRIPTION OF PREFERRED EMBODIMENTS

Figure 1:
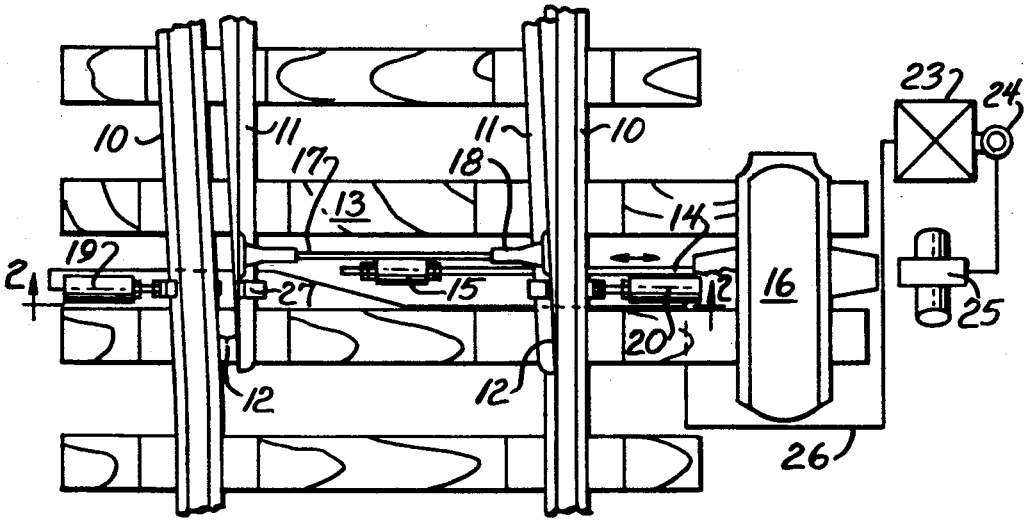
FIG. 1 is a top elevational view of the corresponding points of switchtrack and stockrail with switch members, parts being broken away, showing a novel detector embodying the invention.
Figure 2:
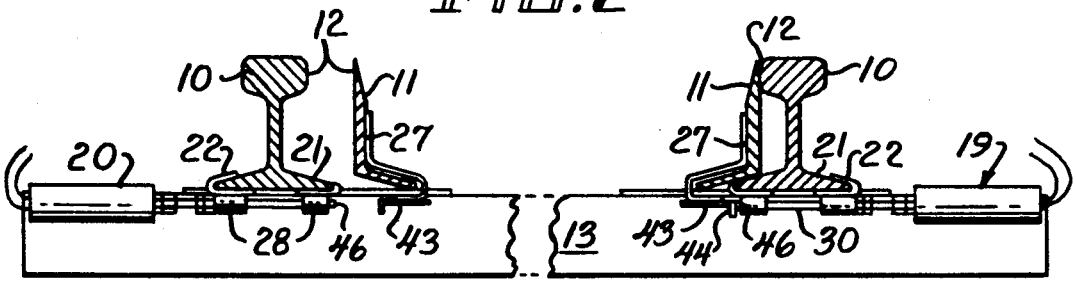
FIG. 2 is an side elevational view, partially in section, of the structure shown in FIG. 1, except omitting the switching members, taken on line 2—2 of FIG. 1.

With reference to the accompanying drawings, in which like numerals represent like structural members, a switch point where spaced apart stockrails or tracks 10 meet spaced apart switchrails 11 is designated as the point 12, and identifies the location where the stockrail or tracks 10 and switch rail 11 must be brought together or closed, or spaced apart or opened, to allow a train to pass thereover without fear of derailment. If the tracks are separated more than about 0.05 of an inch, a derailment may result.

These tracks are mounted laterally on a series of spaced apart ties 13. Conventionally, the opening and closing of the switchtrack 11 against the stockrail 10 at the point 12 is controlled by a switching device, which includes a switch throwrod 14 connected at one end to a switch basket 15 and at its other end spaced apart from the tracks to a switching machine 16, and the basket 15 is connected to the switchrails 11 through a bolt and plate assembly to switch bars 17, the bars being connected to each of the corresponding aligned switchrails 11 by means of bracket assemblies 18, one on each switchrail.

At the point 12, arranged between the ties 13, along the corresponding aligned stockrails 10, there is secured to each of said stockrails, a detector device 19 embodying the present invention. This detector device 19 comprises a housing 20, which contains switch members hereafter described. This housing 20 may be secured to the heel 21 of the stockrail 10 by means of clamp bracket 22. The present invention may also include a solar powered visual indicator 23, which may be a strobe light, or a battery powered lamp 24, or a focusable and magnified indicator 25, which may be connected by electric wires 26 to the detector device 19, of a structure and to be used as described hereafter.

Secured to the stockrail 10, is the clamp bracket 22, which has an open ended jaw 34 and a hooked end jaw 35, attached to a pair of tubular members 28, which are adjustable relative to one another by means of a cap 31 arranged on threaded portion 32 of tube 30, for snug engagement of the jaws 34 and 35 on the stockrail heel 21, thus establishing the general position of the stockrail portion of the detector device. Securely attached to the switchrail 11 is a bracket 27, which may be secured in place by nuts 40, bolts 41 and washers 42, and is adjustable on the switchrail by sliding the bracket 27 along its slot 43 upon loosening the nuts 40, to a selected position and then tightening the nuts. At the remote end of and connected to this bracket 27 is an arm 43, which may be attached to the bracket by means of bolts 44, and the position of the arm 43 relative to the bracket 27 may be adjusted by sliding the arm 43 in the slot 45, which is oriented in the direction of the opening and closing of the switchtrack 11 against the stockrail 10. The end of the arm 43 carries a finger 48, and its adjustment may be varied as described.

This finger 48 is adapted to contact the tip 46 of the shaft 47 which and extends through the pipe body or tube 30. The shaft tip 46 extends through a central opening in cap 31. The shaft 47 is joined to plunger 36 and both are loaded in the direction of the tip 46 by spring 38. The pipe body 30 extends into the housing 20 and may be adjustably secured thereto in a selected position by means of threaded assembly 37.

The housing 20 is torpedo shaped and has threaded end 49, through which the plunger 36 extends, and threaded end 50, having a plug 51, though which wires 52 exit the housing 20. Carried on the plate 54 in the housing 20 are pairs of switch contacts 55 and 56, which may be anchored to the plate, and which may be connected to the wires 52, and this plate 54 may be anchored in the housing by screws 57 connected to an exit coupling 58 attached to the housing 20 through which the wires 52 exit. Secured to the end of the plunger 36 is a male contact 60 which may enter between the contacts 55 and 56. When the plunger 36 is reciprocated against the contacts 55 and 56 upon movement of the tip 46 and shaft 47 the circuit is closed to activate the detector in a manner to be described.

As shown in FIGS. 7-10, the clamp bracket 27, plunger 36, shaft 47, arm 43 and finger 48 and the connecting means for the same are fully adjustable, and the adjustments may be locked into position, so that the contacts may be placed in fixed relation to one another, when adjusted, to always cause the male contact 60 to enter between the contacts 55 and 56, thus opening or closing the circuit, upon reciprocation of the switchrail 11 against the stockrail 10 when the shaft tip 46 is depressed to close the circuit as described. If the point 12 is not completely closed, the tip 46 is biased away from the contacts 55 and 56, and the circuit will not close. If the point 12 is completely closed, the tip 46 will cause the male contact 60 to be thrust against the contacts 55 and 56, causing the circuit to close.

Figure 3:
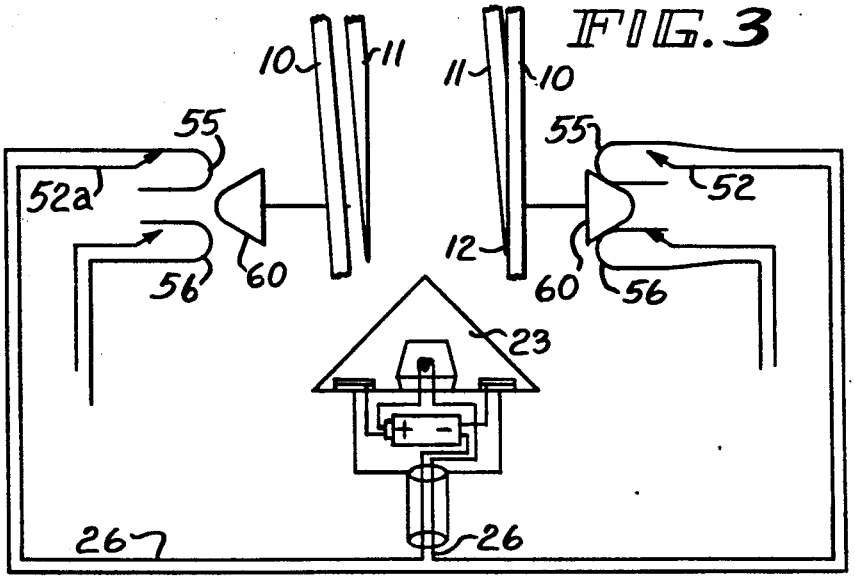
FIG. 3 is a schematic view of the electrical members embodying the present invention, showing the pair of contacts, one in open position and the other in closed position, particularly useful with manually operated switches.
Figure 4:
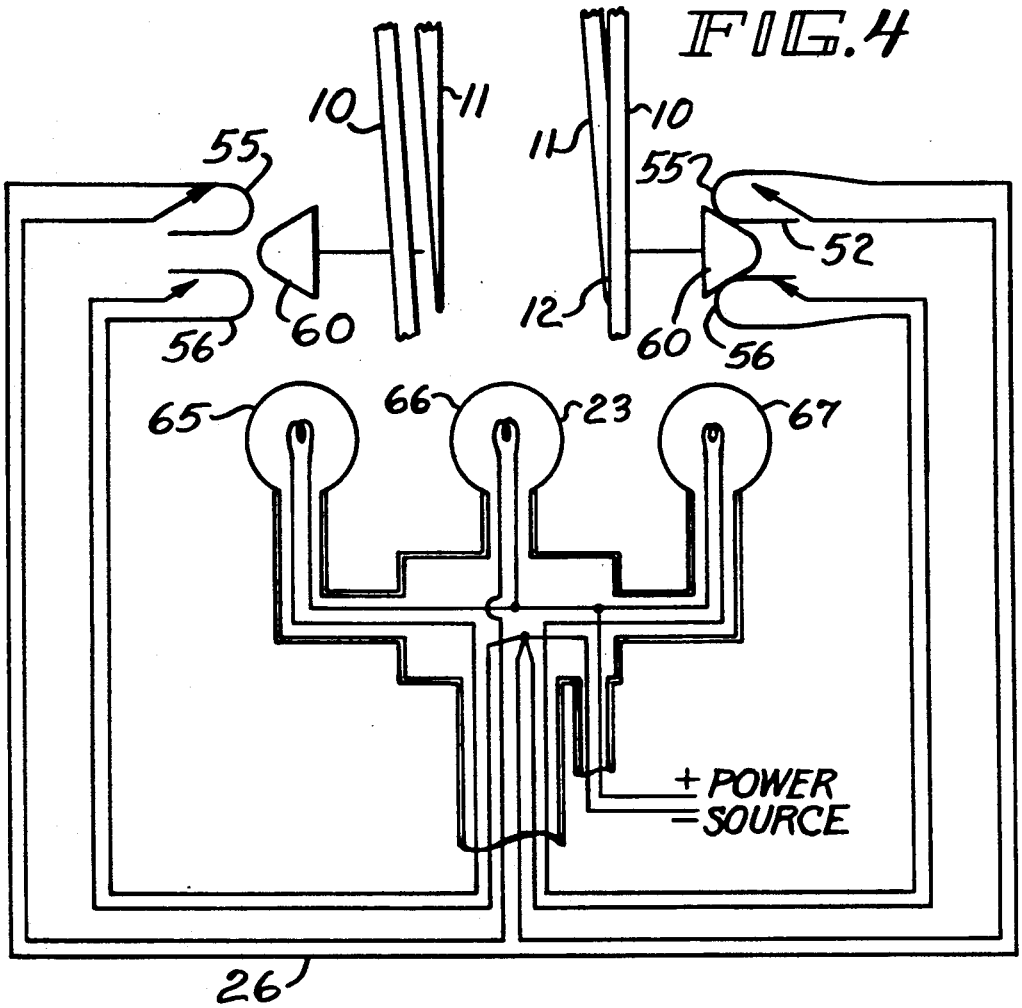
FIG. 4 is another schematic view of electrical members embodying the present invention, showing a modified electrical arrangements, with a pair of contacts, one in open position and the other in closed position, usable where electrical power is available.

As shown in FIGS. 3 and 4, when the male contact 60 is closed against the contacts 55 and 56 (see right side of figure), a circuit is made through the wires 52 and 26, which may switch on an appropriate light 23 in the signal means, such in the yard or tower or other indicia to report the point 12 is closed. On the other hand, if the male contact 60 is not closed against the contacts 55 and 56 (see left side of figure), the circuit is not made and may cause another signal to report that point is open. As shown in FIG. 4, the circuit may be integrated with the line electrical system, and may include a normal signal light 65, a danger signal light 66 and a reverse signal light 67. These signals may be located at the switch in the yard and/or they may be remote from the switchtrack in a control house for the switch yard or other railroad system.

Figure 5:
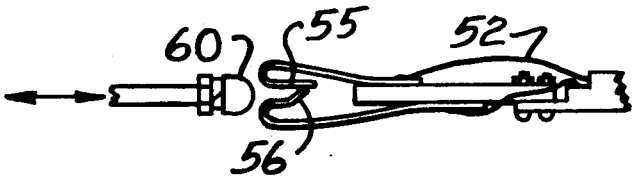
FIG. 5 is a view of the unique contact arrangement for use in the detector embodying the present invention.
Figure 6:
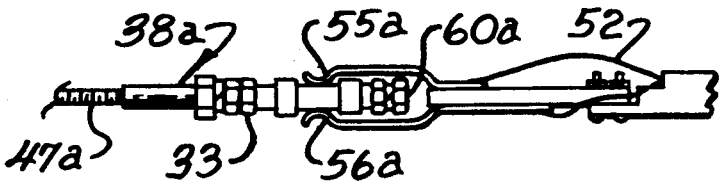
FIG. 6 is a view of a modified contact arrangement similar to the contact arrangement shown in FIG. 5, depicting another embodiment.
Figure 8:
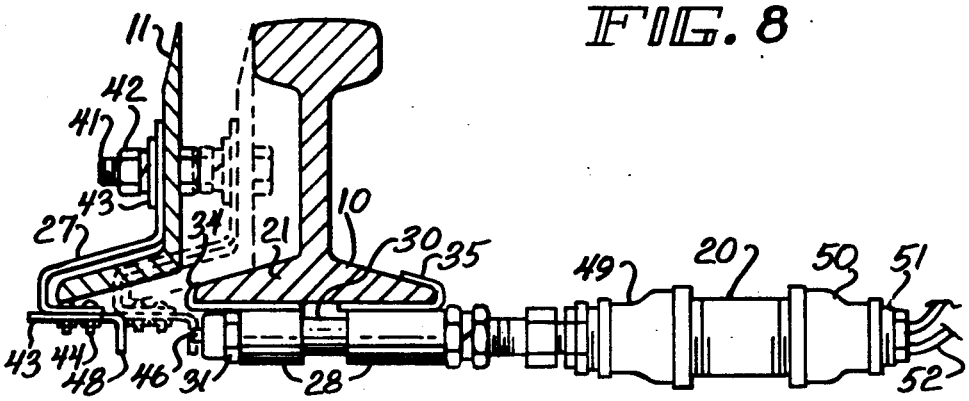
FIG. 8 is an enlarged detail view, partially in section, showing part of the spring loaded plunger assembly for the detector switch embodying the present invention in switch open position, with the closed position of the switchtrack shown in fantom.
Figure 9:
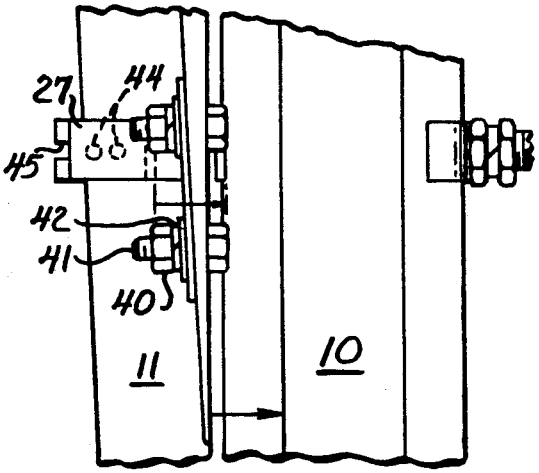
FIG. 9 is an enlarged detail elevational view, taken at a right angle to the view shown in FIG. 8 of the top elevation of an embodiment of the present invention in switch open position.
Figure 10:
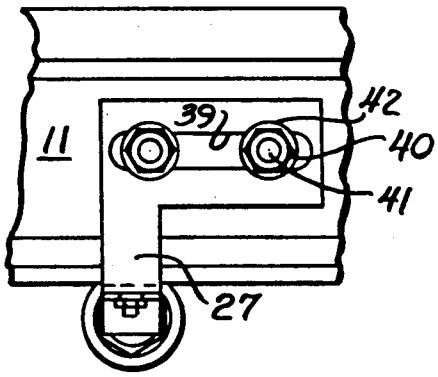
FIG. 10 is a view of the contact bracket of the device as shown in FIG. 9, taken at right angles thereto.
Figure 7:
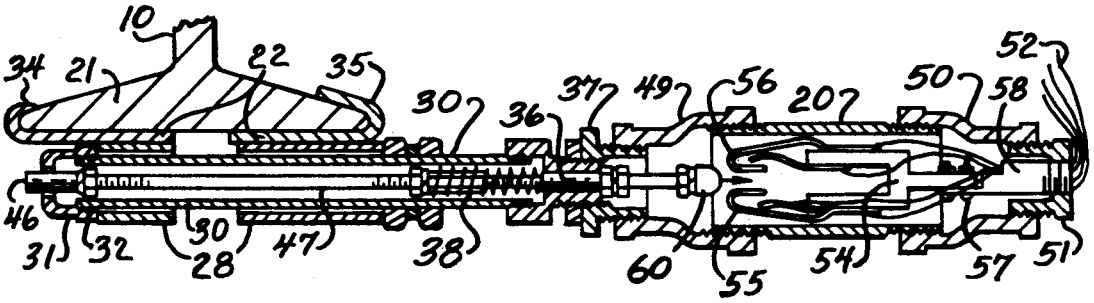
FIG. 7 is an enlarged detail view, partially in section, similar to FIG. 2, of the side elevation of an embodiment of the present invention in switch open position, with the switch plunger out of contact with the detector mechanism, in the manner shown in FIG. 5.

FIGS. 5 and 6 show alternate forms of switch mechanism which may be activated in the matter described when the male contact 60 (shown open) or adjustable male contact 60*a* (shown closed) is thrust between the contacts 55 and 56 (normally closed) or 55*a* and 56*a* (normally closed) to make or break the circuit through wires 52. The plunger mechanism 38*a* in FIG. 6 has numerous adjustment bolts 33 and a threaded shaft 47*a*, which accommodate substantial adjustment when necessary.

Shown in FIGS. 11 and 12 is a solar powered indicator light device usable with the detector device disclosed in this application. Such a device may comprise solar panels 70 arranged to face available light on a frame 71 within a clear housing 72 and elevated from the ground on a pipe stand 73. Preferably, these solar panels 70 are connected to a storage rechargeable nickel cadmium battery 74, which leads to a strobe light 75 also mounted on the frame 71. The wires 26 connecting the detector device 19 allow power generated through the solar panels 70 to pass to the strobe light 75. Thus, if the circuit is closed, the strobe light will flash, noticeably indicating that the switchpoint is open.

With reference to the FIG. 13 embodiment, this lamp 24 is intended for securement on or adjacent a switching machine 16 or it may be freestanding. Such a lamp 24 includes a battery pack 76, which may house one or two batteries 77, for powering a light 78, located within a clear plastic lens 79, which may be elevated above the track by means of a pipe stand 80, and actuated by the detector device through wires 26. Such a device would preferably not be actuated except for short periods of time, as when the switchpoint is open, in order to permit the batteries to last as long as possible. Electronic controls may be included in the battery pack to extend the life of batteries providing power for the lamp.

The indicator device shown in FIGS. 14 and 15 is also preferably solar powered by a solar panel 81, and which may also utilize a strobe or other projection light 82. This visual indicator is particularly novel in that its light 82 is magnified by lenses 84 in a lens housing 85, which may be focused, by rotating the lens housing. The elevation of the lamp and the direction of its projection may also be modified by rotating the lamp housing 86 on its pivotable bracket 87. Such an indicator may wired into the detector circuit by wires 26 to receive the switchpoint open-close information, and it may be set on its pipe stand 88 in a railroad yard in the vicinity of a switchpoint and focused in the direction of a cab coming down an establish route of tracks. If the switchpoint is open, a beam will be projected directly at the engineer. Such a focusable indicator may also be directed to a controller in a tower, or some other operating person. The lens arrangement also permits the lamp to provide a bright and easier to see signal with a lesser power requirement.

FIG. 16 illustrates a typical solar panel 90 which may be utilized in any of the visual indicators shown, and it may also be elevated on a pipe stand 91 and articulatable on a frame 92 so that it can best track the sun which gives it energy..

The detector device embodying the present invention is located and arranged beneath the tracks and within dimensions extending downwardly parallel to the tracks so that the detector mechanism will not interfere with operation of a train traveling thereover. Also the detector mechanism is fully horizontally adjustable, and the detector will be actuated to show the point 12 is actually closed only when the switchtrack 11 is physically manipulated home against the stockrail 10. The detector mechanism disclosed herein may be incorporated into other railroad switchyard, mainline and hump yard systems for the purpose of indicating whether or not the point 12 is in fact open or closed.

The location for installing the safety detector embodying the present invention may be at the locations along the switchpoint, as shown. In some cases the throw of the reciprocating plunger away from the stockrail will have to be lengthened in order to have firm contact with the switchrail, as the space at the point between the stockrail and the switchrail is sometimes tapered from the end of the switchtrack.

While preferred embodiments of the novel detector mechanism has been shown and described in considerable detail, it is not intended that the invention should be limited to the exact construction described, as many variations and changes can be made in details of the structure without departing from the spirit of the invention. Accordingly, the invention should not be limited to the structure described except as the same may be defined by the appended claims.

I claim:

1. A safety detector for a railroad switch point where a switch rail is intended to contact a stock rail in a given plane, said safety detector comprising a detector mechanism secured to said stock rail at said point, said detector mechanism having a spring loaded plunger assembly normally biased in the direction of said switch rail reciprocally secured in alignment with said switch rail at said point and electrical contact means connected to said plunger assembly for reporting contact or the lack of contact between said switch rail and said stock rail, and adjustable means mounted on said switch rail at said point adapted to contact and reciprocate said plunger against said electrical reporting means when said switchrail is in physical contact with said stockrail at said point, said detector mechanism having a housing located beneath said rail for containing said electrical contact means and plunger assembly, said housing comprising a closed body secured to said stockrail, said plunger assembly having a contact tip extending from said housing adjacent said switchrail and an end remote therefrom in contact with said electrical contact means and a rigid connection extending between and affixed to said contact end and said remote end, said electrical contact means comprising electrical contact members secured in said housing and means on said remote end for contacting said electrical contact members when said plunger is reciprocated.

2. The safety detector recited in claim 1, wherein said spring loaded plunger assembly has a contact tip extending from said housing beneath and in alignment with said stock rail and in the direction of said switch rail.

3. The safety detector recited in claim 1, wherein said plunger assembly comprises a movable shaft extending through a fixed pipe body and has a spring biased against said body urging the shaft in the direction of the switch rail.

4. he safety detector recited in claim 3, wherein said movable shaft is adjustably secured in said pipe body.

5. The safety detector recited in claim 1, wherein said stock rail and said switch rail each have a heel, and said plunger assembly is secured to said stock rail at a lever below said heel.

6. The safety detector recited in claim 1, wherein said stock rail has a heel, and said detector mechanism is secured to said heel by adjustable clamps secured thereto.

7. The safety detector recited in claim 1, wherein said housing has a threaded cover for removable secured closing of said housing.

8. The safety detector recited in claim 1, wherein said electrical contact members comprise a male contact element secured at the end of said plunger assembly and a set of aligned contacts which make or break a circuit when said plunger is reciprocated against said aligned contacts.

9. The safety detector recited in claim 8, wherein said male contact element is adjustable on the plunger assembly for selectively adjusting the spacing between said aligned contacts and said male contact element.

10. The safety detector recited in claim 1, wherein said adjustable means comprises a bracket adjustably secured on said switch rail.

11. The safety detector recited in claim 10, wherein said bracket has an arm extending from said switch rail adapted to contact said plunger assembly when said point is closed on said stock rail.

12. The safety detector recited in claim 11, wherein said arm has a finger which is bent toward said stockrail a distance sufficient to permit said switch rail to close against said stockrail before said finger fully reciprocates said plunger assembly.

13. A safety detector for a rail road switch point where a switch rail is intended to contact a stock rail in a given plane, said safety detector comprising a detector mechanism secured to said stock rail at said point, said detector mechanism having a spring loaded plunger assembly normally biased in the direction of said switch rail reciprocally secured in horizontal alignment with said switch rail at said point and electrical contact means connected to said plunger assembly for reporting contact or the lack of contact between said switchrail and said stockrail, and contact means on said switch rail at said point for reciprocating said plunger assembly against said electrical reporting means when said switchrail is in physical contact with said stockrail at said point, said detector mechanism having a closed housing located below and adjustably attached to said stock rail for containing said electrical contact means and plunger assembly, said plunger assembly having a contact end adjacent said stock rail and an end remote therefrom in contact with said electrical contact means, said electrical contact means comprising electrical contact members secured in said housing and means on said remote end for contacting said electrical contact members when said plunger assembly is reciprocated.

14. The safety detector recited in claim 13, wherein said contact end is reciprocated in a pipe body and only a tip of said contact end of said plunger assembly adapted to contact said switch rail is exposed and extends from said pipe body.

15.The safety detector recited in claim 14, wherein said plunger assembly is adjustable relative to said electrical contact means.

16. The safety detector recited in claim 14, wherein said electrical contact means is connected to a visual indicator device which is actuated when said plunger assembly is reciprocated against said contact means.

17. The safety detector recited in claim 16, wherein said visual indicator device is solar powered.

18. The safety detector recited in claim 17, wherein said solar power is supplied from solar panels located on said device.

19. The safety detector recited in claim 16, wherein said visual indicator device comprises a strobe light member.

20. The safety detector recited in claim 16, where said visual indicator device is battery powered and controlled by said electrical contact means.

21. The safety detector recited in claim 16, where said visual indicator device comprises a source of light arranged behind a magnifying lens.

22. The safety detector recited in claim 21, where said light source and lens is secured in a housing which is articulatable.

23. The safety detector recited in claim 21, wherein said lens is adjustable.

24. A safety detector for a railroad switch point where rails consisting of a switch rail and a stock rail are intended to contact one another in a given plane, said safety detector comprising:

a detector mechanism adjustably secured to one of said rails at said point, said detector mechanism having means directed towards said other rail to report whether there is substantial contact between said rails at said point, a housing located beneath said rails adjustably attached to said rail to which said detector mechanism is secured, electrical contact means in said housing adapted to receive the report of said detector mechanism, and a connecting assembly connecting said detector mechanism and said contact means, said connecting assembly having a contact end adjacent said detector mechanism and an end remote therefrom in contact with said electrical contact means, said electrical contact means comprising electrical contact members secured in said housing and means on said remote end for actuating said electrical contact members when contacted by said connecting assembly, and a visual indicator mechanism connected to said electrical contact means for reporting whether said switch point is open or closed responsive to contact between said rails.

25. The safety detector recited in claim 24, wherein said rails have a heel and a clamping member is secured on the heel of said rail to which said detector mechanism is secured.

26. The safety detector recited in claim 25, wherein said clamping assembly is adjustable relative to said housing.

27. The safety detector recited in claim 24, wherein said detector mechanism, connecting assembly and electrical contact means are arranged aligned with but beneath the heel of said rails.

* * * * *